United States Patent [19]

Rassaian

[11] Patent Number: 4,679,507

[45] Date of Patent: Jul. 14, 1987

[54] THREE-AXLE RAILWAY TRUCK STEERING LINKAGE

[75] Inventor: Mostafa Rassaian, Lisle, Ill.

[73] Assignee: General Motors Corporation, Detroit, Mich.

[21] Appl. No.: 803,439

[22] Filed: Dec. 2, 1985

[51] Int. Cl.[4] ..... B61B 3/06; B61B 5/38

[52] U.S. Cl. ..... 105/136; 105/166; 105/168; 105/176

[58] Field of Search ..... 105/136, 165–168, 105/175 R, 176, 196, 175.1

[56] References Cited

U.S. PATENT DOCUMENTS

| | | | |
|---|---|---|---|
| 724,271 | 3/1903 | Ellery | 105/166 |
| 1,723,720 | 8/1929 | Buchli | 105/109 |
| 1,728,096 | 9/1929 | Algrain | 105/166 |
| 4,040,361 | 8/1977 | Jackson | 105/136 |
| 4,135,456 | 1/1979 | Welsh | 105/135 |
| 4,164,188 | 8/1979 | Hallam et al. | 105/166 |
| 4,170,179 | 10/1979 | Vogel | 105/168 |
| 4,417,525 | 11/1983 | Levy | 105/166 |
| 4,440,094 | 4/1984 | Levy | 105/166 |

FOREIGN PATENT DOCUMENTS

| | | | |
|---|---|---|---|
| 837711 | 5/1952 | Fed. Rep. of Germany | 105/165 |
| 1291352 | 3/1969 | Fed. Rep. of Germany | 105/176 |

*Primary Examiner*—Randolph A. Reese

*Attorney, Agent, or Firm*—Robert J. Outland

[57] ABSTRACT

A three-axle powered self-steering railway truck is disclosed having a five link steering linkage connected between the axles on either side of the truck and interconnected laterally to provide radial steering action of the end axles linked to lateral translation of the center axle during curve negotiation. The steering and traction linkage is positioned to be free of interference with the traction motors and drive gears.

7 Claims, 3 Drawing Figures

THREE-AXLE RAILWAY TRUCK STEERING LINKAGE

FIELD

This invention relates to railway trucks particularly for self-powered vehicles such as locomotives and more particularly to steering linkage for a self-steering three-axle powered railway truck.

BACKGROUND

The development of steering axle railway trucks for powered vehicles such as locomotives has been complicated by the problems of providing axle interconnecting and load transmitting linkages in the space available within powered locomotive trucks. The manner in which the axles should be interconnected in order to provide the most desirable operating conditions and curving efficiency has also been a matter for consideration.

INVENTION SUMMARY

The present invention provides a three-axle railway truck having steering linkage interconnecting the outer ends of the axles and providing a predetermined relation between lateral motion of the center axle and equal and opposite turning or yawing motions of the end axles. The combination provides a linkage arrangement outside the zone occupied by the traction motors and driving mechanism which accomplishes steering interconnection in a manner considered desirable for efficient low friction radial axle positioning for curving control.

These and other features and advantages of the invention will be more fully understood from the following description of a selected embodiment taken together with the accompanying drawings.

DRAWINGS

DESCRIPTION

Figure 1:
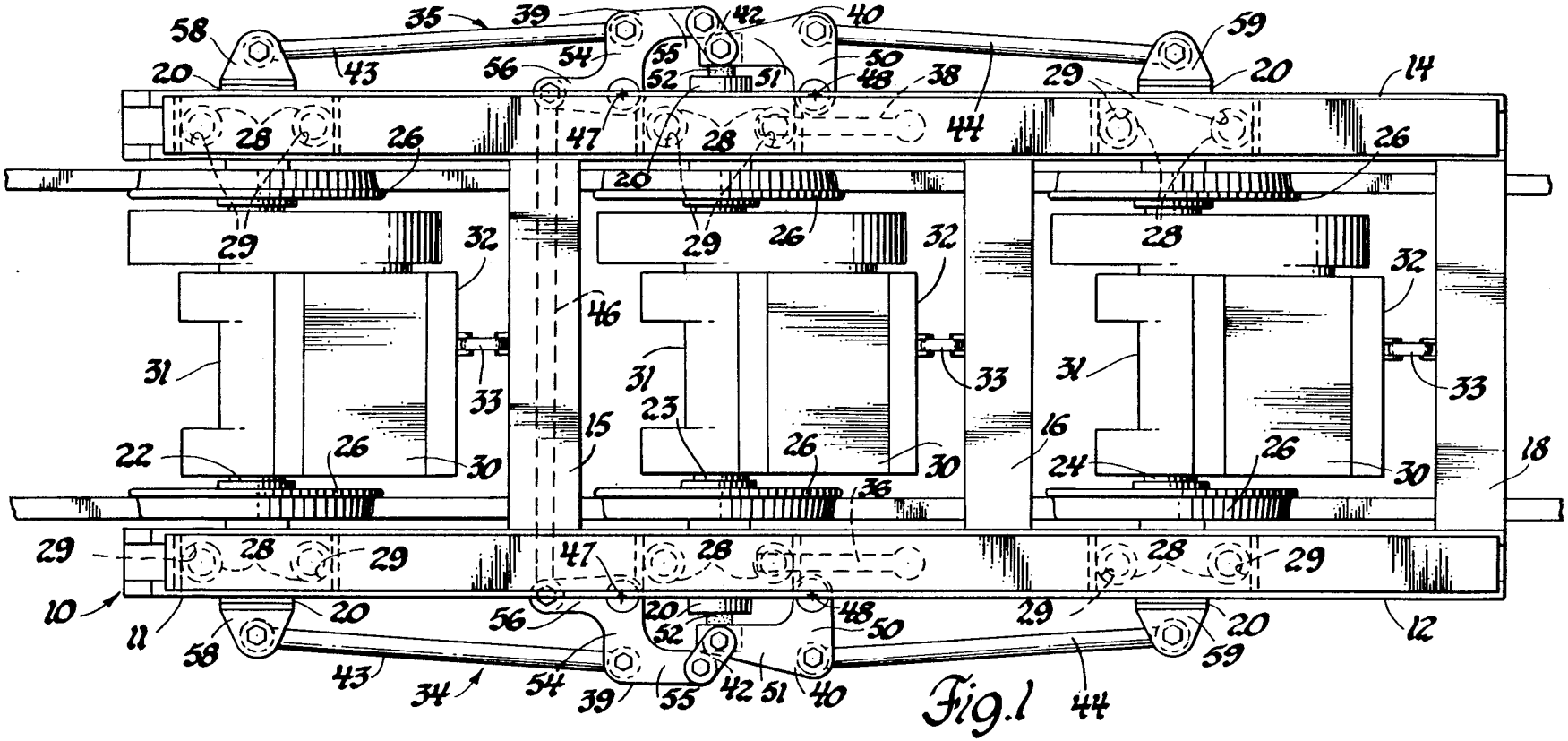
FIG. 1 is a top plan view of a railway locomotive truck having steering linkage in accordance with the invention and illustrated in the position for straight line operation on tangent track.
Figure 2:
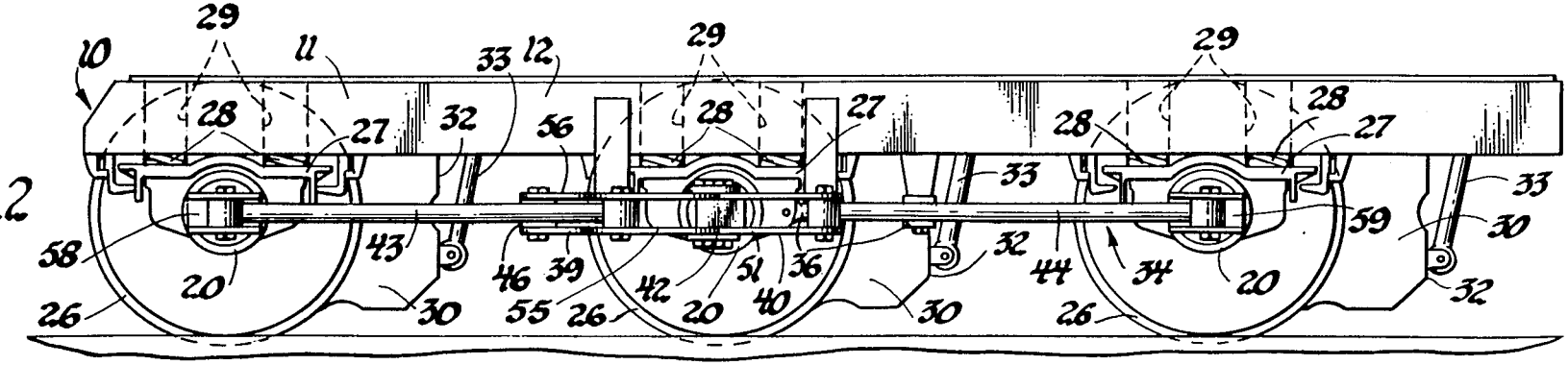
FIG. 2 is a side view of the locomotive truck illustrated in FIG. 1.
Figure 3:
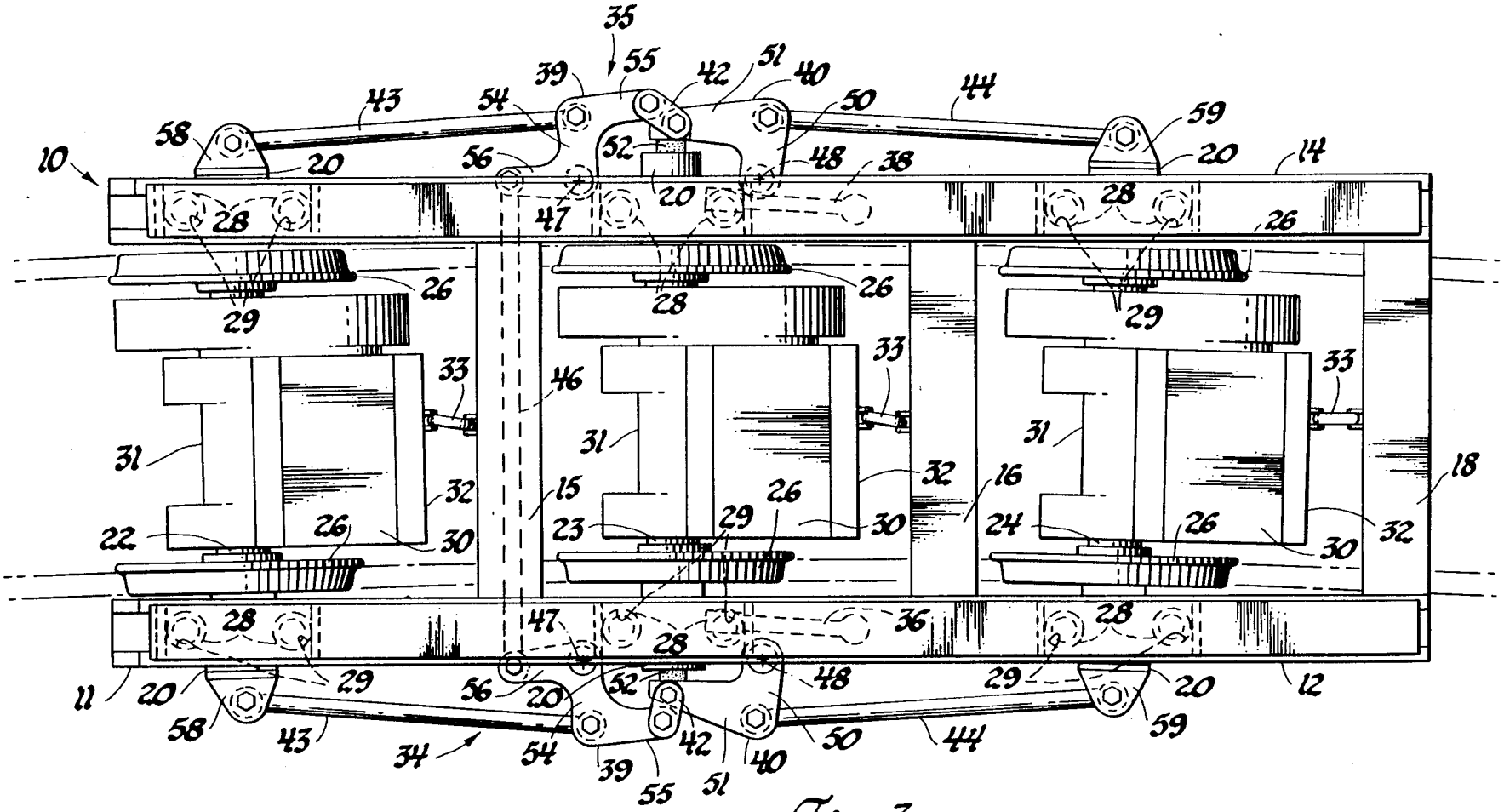
FIG. 3 is a top plan view similar to FIG. 1 but showing the truck components in a turning mode during operation on curved track.

In the drawings, numeral 10 generally indicates a powered three-axle self-steering railway locomotive truck having a frame 11 including a pair of side frames 12, 14 interconnected by three longitudinally spaced laterally extending transoms 15, 16, 18.

The truck frame 11 is supported by resilient suspension means including roller bearing adapters or housings 20 carried on the ends of longitudinally spaced and laterally extending front, center and rear axles 22, 23, 24, respectively. The axles are supported by wheels 26 mounted inboard of the bearing housings 20 near the axles's opposite ends. A bolster, not shown, is conventionally mounted on the truck frame for connecting the truck with a carbody of a locomotive or other self-propelled vehicle. If desired, a bolsterless arrangement may be employed wherein the truck frame directly supports the carbody and traction rods transfer longitudinal traction and braking forces therebetween.

In addition to the bearing housings 20, the suspension means include spring seats 27 and coil springs 28 which extend into pockets 29 in the frame to resiliently support the frame on the wheel and axle assemblies. The suspension means are operative to yieldably urge the wheel and axle assemblies into nominally straight ahead aligned positions, as shown in FIG. 1, for operation on tangent track but their resilience permits lateral and yawing motions of the wheel and axle assemblies within established limits. Suitable lateral and longitudinal stops are provided to limit these motions of the wheel and axle assemblies. The suspension and stop means of the illustrated embodiment are of the type described in the copending U.S. patent application Ser. No. 800,321 filed Nov. 21, 1985 and assigned to the assignee of the present invention. However any other suitable form of suspension means and or stop arrangements could, of course, be utilized if desired.

For powering the wheel and axle assemblies to drive the locomotive, the truck is provided with three traction motors 30, one for each axle. Each motor has a forward side 31 supported on one of the axles by conventional axle bearing means and a rearward side 32 supported from an adjacent one of the transoms 15, 16, 18 by a depending link 33. The link is flexibly or swively connected at its ends to allow a limited amount of both longitudinal and lateral motion between the traction motor and the adjacent transom member by which it is supported.

To provide for limited self-steering action of the wheel and axle assemblies while transmitting traction and braking forces between the wheel and axle assemblies and the truck frame, the truck is provided with steering and restraining mechanism including a pair of laterally interconnected linkages generally indicated by numerals 34 and 35, one on either side of the truck. In addition means are provided for restraining the center axle in the form of parallel traction rods 36, 38 connecting the bearing housings 20 of the center axle with generally longitudinally aligned rearwardly spaced locations of the truck side frames 12, 14 respectively. The traction rods 36, 38 are mounted with rubber bushings, swivel joints or the like and prevent yawing of the center axle with respect to the truck frame while allowing lateral and vertical motions of the center axle within the limits permitted by the suspension and stop means and the linkages to be subsequently described.

Each of the linkages 34, 35 includes first and second levers 39, 40 respectively, a link 42 and front and rear traction rods 43, 44 respectively. A connecting link 46 is also provided. In each of the linkages 34, 35, the levers 39, 40 are pivoted on centers 47, 48 respectively, positioned near the outer edges of the frame at points equally spaced on opposite sides of the center axle.

Each lever 40 has an angle shaped body having an outwardly extending leg 50 and a longitudinally extending finger 51 which extends into operative engagement with the end of the center axle. Preferably rubber thrust pads 52 are provided on the ends of the fingers 51 and are operatively engaged by the the ends of the axles, a small clearance being provided to allow small high frequency axial motions of the center axle to occur without corresponding movements of the levers 40.

In like manner each of the levers 39 includes an angled body portion having an outwardly extending leg 54 and a longitudinally extending finger 55 that extends outboard of the center axle. The ends of the fingers 55 are connected with the adjacent ends of fingers 51 of the levers 40 by the links 42. Levers 39 further include arms 56 which extend forwardly from their pivot centers 47 and the ends of which are interconnected by the connecting link 46 which extends laterally of the truck under the forward transom 15.

The levers 39 are also connected with fittings 58 on the outer ends of the bearing housings 20 of the front axle 22 by the front traction rods 43 which extend longitudinally between the fittings 58 and points near the outer ends of the legs 54 of the levers 39. In like manner the rear traction rods 44 connect fittings 59 on the ends of the bearing housings 20 of the rear axle 24 with points near the outer ends of the legs 50 of the levers 40.

The described linkage provides a positive interconnection of the three axles of the truck to require equal and opposite yawing motions thereof linked with predetermined lateral motion of the center axle. The geometric relations of the linkage elements are preferably arranged so as to relate the axial displacement of the center axle caused by negotiation of track of a fixed curvature to the yawing motion of the end axles to maintain these axles in substantially radial positions relative to the curve.

In operation, tractive and braking forces on the wheels are transferred to the journal housings 20 and into the traction rods 36, 38, 43 and 44 and, through the interconnecting levers 39, 40, into the truck frame. When the truck enters a curve, the wheel and axle assemblies of the truck may, either through self-steering action or through the forced lateral motion of the center axle, require the end axles to yaw in opposite directions to take up positions substantially radial to the curve. This positioning is not substantially affected by limited lateral movement of the end axles which do not affect the steering function.

The magnitude of axle yawing associated with lateral translation of the middle axle during curve negotiation is controlled by the lever ratios chosen for the five link mechanism, which is preferably optimized to provide radial positioning of the outer axles during curve negotiation. A lateral clearance is preferably provided between the ends of the middle axle and the rubber pads at the ends of the fingers 51 to allow a small amount of high frequency lateral motion without causing corresponding motion of the steering linkages. This will also avoid the coupling of vertical and lateral motions of the center axle.

If desired, a yaw damper, not shown, could be incorporated in parallel with one of the trust pads 52 acting on the middle axle to insure dynamic stability in the motion of the center axle. Also if desired, the links 42 could be replaced by rubber stops or bushings acting between fingers 51, 55 of the levers 39, 40, the bushings being resilient to absorb the relative longitudinal motion of the ends of the fingers with respect to one another during curve negotiation. Alternatively, it would be possible to link together the ends of the fingers as shown and eliminate substantial clearance between the ends of the inner fingers 51 and the center axle and to eliminate the connecting link 46 from between the linkages, in which case the center axle itself would provide the necessary interconnection between the linkages 34, 35.

It should be noted that the use of the terms front, rear, forward, rearward and the like in describing the various elements and directions relating to the illustrated embodiment of a railway truck are for descriptive purposes only and are not intended to limit the application of the railway truck in a locomotive or the like to any particular direction of operation since operation in either direction may be equally acceptable.

Further, it should be apparent that various forms of primary and secondary suspension systems could be utilized with the truck, in addition to or in place of those illustrated, without changing the basic principles of the steering mechanism disclosed herein.

Finally, it should be noted that the various features of the invention which have been illustrated in the described railway truck embodiment are not necessarily limited to application in mechanisms of the type described. Accordingly, the invention and its various features should not be limited to the described embodiment but should have the full scope permitted by the language of the following claims.

The embodiments of the invention in which an exclusive property or privilege is claimed are defined as follows:

1. Steering and restraining mechanism in combination with a three-axle steering railway truck including a frame support by front, center and rear sequentially longitudinally spaced axles, each having a pair of flanged wheels secured near its opposite ends, and yieldable suspension means between the axles and the frame, and nominally urging the axles into centered positions for motion along straight paths but permitting limited yawing and lateral movement of said axles, said steering and restraining mechanism carrying all traction and braking forces between the axles and the frame, and comprising restraining means establishing an essentially fixed longitudinal relation between the frame and said center axle and transmitting all its traction and braking forces to the frame but permitting relative vertical and lateral motion therebetween, a pair of linkages, one on each side of the truck and interrelating the ends of the axles on its respective side, the linkages being interconnected laterally across the frame for equal and opposite motion, each linkage including first and second levers operatively laterally engaging one end of the center axle and pivoted at points of the frame longitudinally spaced toward the front and rear axles, respectively, from said one end of the center axle, a front traction rod longitudinally connecting a point of said first lever laterally outboard of its pivot with one end of the front axle, and a rear traction rod longitudinally connecting a point of said second lever laterally outboard of its pivot with one end of the rear axle, said front and rear traction rods exclusively carrying all traction and braking forces from their respective axles to the frame, said levers, rods and points being related in a manner to require equal and opposite yawing movements of the front and rear axles to correspond with predetermined lateral movements of the center axles to provide substantially radial positioning of the axles during negotiation of a constant curve.

2. A combination as in claim 1 wherein said levers are operatively connected with the associated ends of the center axle to provide said lateral interconnection of said linkages.

3. A combination as in claim 1 and further including traction motors, one drivingly connected with each of said axles and carried inboard of the truck sides, wherein said linkages are located substantially outboard of the truck sides to effect axle interrelation free of encroachment into the locations occupied by said motors.

4. Steering and restraining mechanism in combination with a three-axle self-steering railway truck including a frame supported by front, center and rear sequentially longitudinally spaced axles, each having a pair of flanged wheels secured near its opposite ends, and yieldable suspension means between the axles and the frame, and nominally urging the axles into centered positions for motion along straight paths but permitting limited yawing and lateral movement of said axles said steering and restraining mechanism carrying all traction and braking forces between the axles and the frame, and comprising restraining means establishing an essentially fixed longitudinal relation between the frame and said center axle and transmitting all its traction and braking forces to the frame but permitting relative vertical and lateral motion therebetween, a pair of linkages, one on each side of the truck and interrelating the ends of the axles on its respective side, each linkage including first and second levers operatively laterally engaging one end of the center axle and pivoted at points of the frame longitudinally spaced toward the front and rear axles, respectively, from said one end of the center axle, a front traction rod longitudinally connecting a point of said first lever laterally outboard of its pivot with one end of the front axle, and a rear traction rod longitudinally connecting a point of said second lever laterally outboard of its pivot with one end of the rear axle, said front and rear traction rods exclusively carrying all traction and braking forces from their respective axles to the frame, said first levers having arms extending longitudinally in one direction from their pivots, said arms being connected laterally across the frame by a link interconnecting the linkages for equal and opposite motion, said levers, rods and points being related in a manner to require equal and opposite yawing movements of the front and rear axles to correspond with predetermined lateral movements of the center axle to provide substantially radial positioning of the axles during negotiation of a constant curve.

5. A combination as in claim 4 wherein one of said first and second levers of each linkage substantially directly engages the associated end of the center axle and the other of said levers in each linkage indirectly engages the said axle end through engagement with said one lever.

6. A combination as in claim 5 wherein said levers are connected by a link adjacent the associated end of the center axle.

7. A combination as in claim 4 and further including traction motors, one drivingly connected with each of said axles and carried inboard of the truck sides, wherein said linkages are located substantially outboard of the truck sides to effect axle interrelation free of encroachment into the locations occupied by said motors.

* * * * *